United States Patent [19]

Boinski

[11] Patent Number: 4,650,943

[45] Date of Patent: Mar. 17, 1987

[54] SLIDE SWITCH

[75] Inventor: Harro Boinski, Berlin, Fed. Rep. of Germany

[73] Assignee: ITT Industries, Inc., New York, N.Y.

[21] Appl. No.: 396,413

[22] Filed: Jul. 8, 1982

[30] Foreign Application Priority Data

Aug. 5, 1981 [DE] Fed. Rep. of Germany ..... 3130952

[51] Int. Cl.[4] ..... H01H 3/42; H01H 15/16

[52] U.S. Cl. ..... 200/153 LA; 200/284; 200/283; 200/6 BB

[58] Field of Search ..... 200/153 LA, 6 R, 6 B, 200/6 C, 6 BB, 16 R, 16 D, 283, 237, 238, 284, 248; 29/622, 879

[56] References Cited

U.S. PATENT DOCUMENTS

| | | | |
|---|---|---|---|
| 1,986,527 | 1/1935 | Rach et al. | 200/153 LA |
| 2,900,460 | 8/1959 | Wallace | 200/16 R |
| 2,909,624 | 10/1959 | Colautti | 200/6 R |
| 3,105,127 | 9/1963 | Peters | 200/153 LA |
| 3,544,740 | 12/1967 | Robin | 200/284 X |
| 3,562,464 | 2/1971 | Vollum et al. | 200/153 LA |
| 3,835,276 | 9/1974 | Field | 200/153 LA X |
| 4,260,862 | 4/1981 | Orcutt | 200/283 X |
| 4,319,100 | 3/1982 | Tallody | 200/16 R |
| 4,357,510 | 11/1982 | Fortuna | 200/283 |

FOREIGN PATENT DOCUMENTS

| | | | |
|---|---|---|---|
| 0534960 | 3/1941 | United Kingdom | 200/16 R |

*Primary Examiner*—Stephen Marcus
*Assistant Examiner*—Ernest G. Cusick
*Attorney, Agent, or Firm*—James B. Raden; William J. Michals

[57] ABSTRACT

A slide switch comprising fixed contacts and a contact bridge which, by displacing a slider provided with cams, can be tilted so that one of its ends comes in touch with a further fixed contact. The contact bridge is firmly connected by being welded thereto. This results in a reliable center contact which avoids chatter and phenomena of wear.

4 Claims, 8 Drawing Figures

SLIDE SWITCH

BACKGROUND OF THE INVENTION

The invention relates to a slide switch comprising fixed contacts arranged inside a switch housing, and a slider which is capable of being displaced inside the housing, and is provided with cams by which a movable, resilient contact bridge which, with its center part, is supported on a central fixed contact, can be turned in such a way that it, with one end, comes into an electrical contact with a lateral fixed contact.

Various types of embodiments of slide switches are already known in which the slider with its cams as moulded thereto, is capable of tilting a contact bridge towards either the one or the other side, in order thus to make or break electrical contacts with the fixed contacts as arranged inside the housing. Such types of slide switches are disclosed, for example, in the (Applicant's earlier) German Patent No. 1,158,151, as well as in DE-OS No. 1,640,754, DE-OS No. 2,121,421, DE-OS No. 2,162,852, and in (Applicant's earlier) DE-AS No. 2,409,604.

Relative thereto, the tiltable contact bridge may be designed either as a rigid component part which, by the action of a spring, is pressed into its operative position, or as a self-elastic part. In any case, the contact bridge is tilted by the slider, with it turning about a fixed contact designed as a rocker bearing. Either the one or the other end of the contact bridge, during the tilting operation, comes in touch with a further fixed contact. In this way there is established the electrical connection between the central fixed contact design as the rocker bearing, and one of the outer fixed contacts.

The conventional type of embodiment suffers from various drawbacks which are due to the rocker bearing on the central fixed contact. Owing to the mechanical stressing of the rocker bearing during each switching operation, the phenomena of wearing appear at this bearing, so that in the course of time an exact guidance of the contact bridge in the bearing is no longer safeguarded. In the extreme case, the contact bridge may even become detached from its bearing. The rocker bearing is also of disadvantage insofar as the transfer resistance between the central fixed contact and the contact bridge varies permanently, and because the mechanical phenomena of wear may even cause a loose contact. Owing to the abrasion of the cam of the slider, dust particles are likely to enter the rocker bearing which likewise have a negative influence on the contact making.

Finally, the conventional slide switches of the aforementioned type tend to show bouncing phenomena, because owing to the sudden tilting of the contact bridge, the free end thereof is caused to oscillate, with the oscillations being transferred to the end resting on the fixed contact at the extreme end.

It is the object of the present invention to make slide switches of the type mentioned hereinbefore less susceptible to wear, more chatter-proof and more reliable.

This object is achieved by taking the measures set forth in the appended claims. Advantageous further embodiments of the invention are set forth in the subclaims.

SUMMARY OF THE INVENTION

Briefly, a slide switch comprising fixed contacts arranged inside a switch housing is provided. The switch includes a slider which is capable of being displaced inside the housing, and is provided with cams by which a movable, resilient contact bridge which, with its center part, is supported on a central fixed contact, can be turned in such a way that it, with one end, comes into an electrical contact with a lateral fixed contact. In accordance with the present invention the contact bridge is mounted to the central fixed contact.

BRIEF DESCRIPTION OF THE DRAWING

The invention and advantageous further embodiments thereof will now be described with reference to FIGS. 1 to 8 of the accompanying drawings, in which:

FIGS. 1 and 2 show two different sections taken through a slide switch according to the invention, with FIG. 1 showing a vertical section taken on the line A-B of FIG. 2, while FIG. 2 shows a horizontal section taken through the switch. The drawings only show the essential parts of the switch, and these also only schematically.

DETAILED DESCRIPTION

Figure 1:
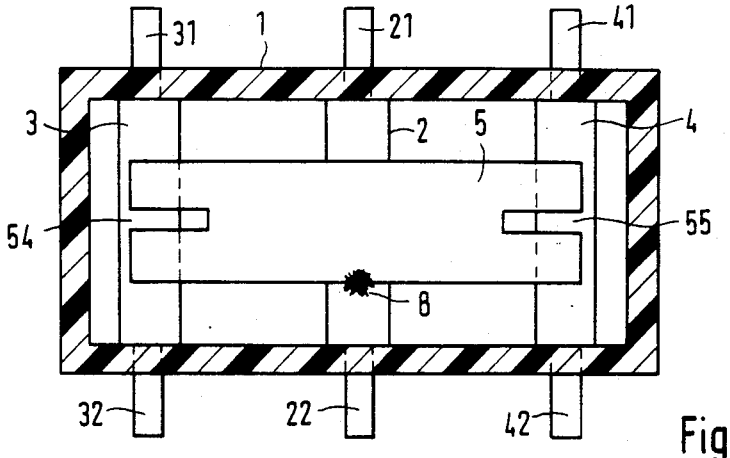
FIG. 1 is a vertical section taken through a slide switch according to the invention along the line A-B of FIG. 2.
Figure 2:
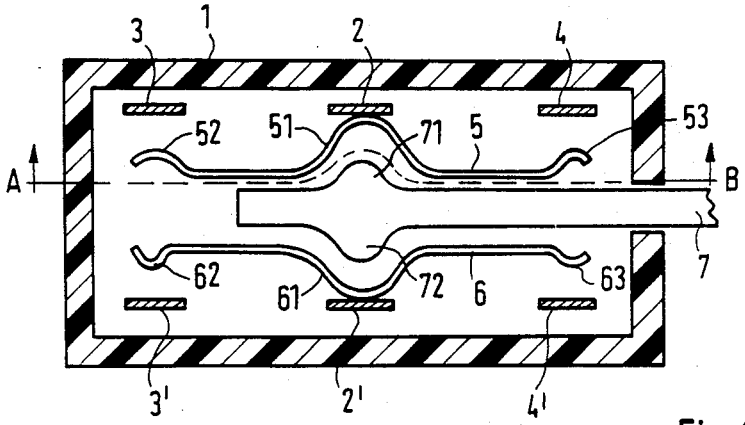
FIG. 2 is a horizontal section taken through a slide switch according to the invention, FIGS. 3 and 4, just like FIG. 2, are horizontal sections taken through a slide switch according to the invention, in different switch positions.
Figure 3:
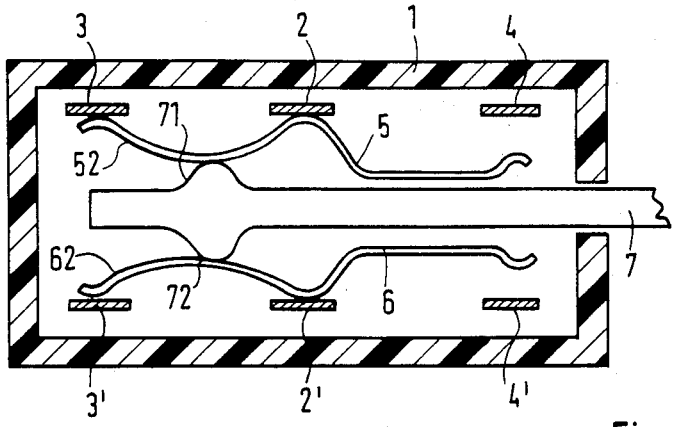
Figure 4:
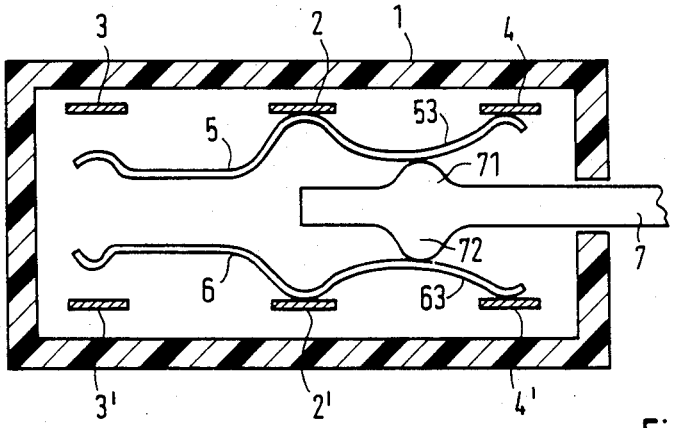

The slide switch as shown in FIGS. 1 and 2 is provided with a housing 1 which, as a rule, is made of a suitable plastics material. Inside the switch housing 1 the fixed contacts 2, 3, and 4 are arranged. The fixed contact 2 forms the central fixed contact, while the contacts 3 and 4 represent the outer fixed contacts. In the present case, the fixed contacts are provided with attachments projecting as terminals out of the housing 1. In the shown example of embodiment, the fixed contact 2 is provided with two such attachments 21 and 22, while the fixed contact 3 is provided with the attachments 31 and 32, and the fixed contact 4 is provided with the attachments 41 and 42 projecting above and below out of the housing 1. The contact bridge 5 is applied to the central fixed contact 2, i.e., with the center of its bulging 51. As can be seen from FIG. 2, there are provided two oppositely arranged contact bridges 5 and 6, with the center of the bulging 51 of the contact bridge 6 being applied to the fixed contact 2'. Moreover, it can be seen from FIG. 2 that between the two contact bridges 5 and 6 there is arranged a slider 7 which is provided with two cams 71 and 72. In the drawing, the slider is merely shown schematically, with guide means of the slider, the actuating button and the possibly provided reset spring having been omitted. By displacing the slider 7 towards the left or the right out of the mid-position as shown in FIG. 2, the end members 52 or 53 of the contact bridges 5 or 6 are brought into contact with the fixed contacts 3 or 3' respectively, in the known manner, thus completing the circuit between the central contact 2 and the outer fixed contact 3 or between the central contact 2' and the outer fixed contact 3' respectively. The switch position in which the slider 7 is shifted to the left, is shown in FIG. 3, while the switch position, in which the slider 7 is shifted to the right, is shown in FIG. 4.

According to the invention, instead of a rocker bearing, there is now provided a firm connection between the central fixed contact 2 and the contact bridge 5 as applied thereto. This connection can be established in a simple way by a welded joint, as is indicated by the reference numeral 8 in FIG. 1. By this firm mechanical connection between the contact bridge 5 and the central fixed contact 2 there is obtained, on the one hand, a permanently good and uniform current transfer between the central fixed contact 2 and the contact bridge 5, with the transfer resistance between the two parts not being changed even in the case of a long-lasting actuation of the switch. On the other hand, there are avoided the mechanical wear phenomena of the rocker bearing, so that the switch altogether is of a substantially higher reliability. The end members 52 and 53 of the contact bridge 5 are provided with slots 54 and 55, this resulting in double contacts on both sides, so that also at this point the contact-making reliability is increased. The welded area only extends over a portion of the width of the contact bridge 5, so that, for example, in the arrangement according to FIG. 1, the upper part of the contact bridge 5 is only applied to the central fixed contact 2 while the lower part, by the welded joint 8, is firmly connected to the central fixed contact 2. In this way, despite the pointwise welding of the two parts, there is still maintained a certain movability of both parts in relation to one another.

The central fixed contact 2 may be designed, in the usual way, as a rigid contact member. In order to further increase the movability of the contact bridge in spite of the mechanical firm connection to the central fixed contact in the center part, the central fixed contact may be designed to be more or less flexible, which will be explained in greater detail hereinafter with reference to FIG. 8.

Figure 5:
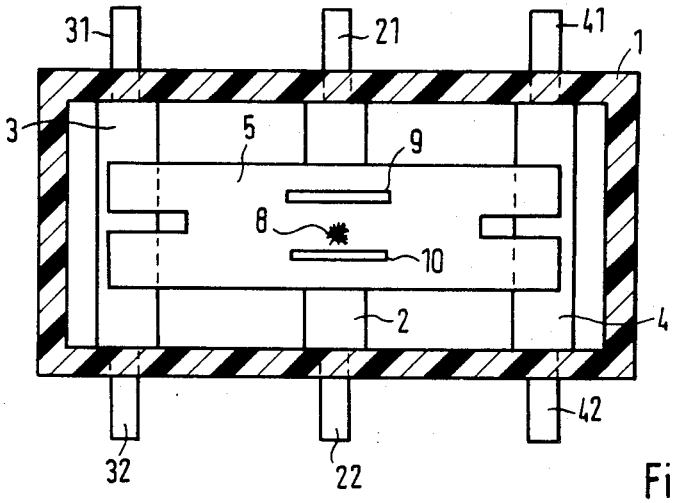
FIG. 5 is a vertical section similar to FIG. 1 and taken through a slide switch according to an alternate embodiment of the present invention wherein slots are provided on the moving contact to enhance its movability.

Another possibility of increasing the movability of the contact bridge 5 in the center part and in spite of the firm connection, is shown in FIG. 5. In this type of embodiment, the contact bridge 5 is welded to the central fixed contact 2 in the center at the point indicated by the reference numeral 8. Above and below the welded joint, however, the contact bridge 5 is provided with slots 9 and 10, so that in spite of the firm connection between the contact bridge and the central fixed contact, there is still achieved a certain movability of the contact bridge on the upper and the lower longitudinal sides thereof.

Figure 6:
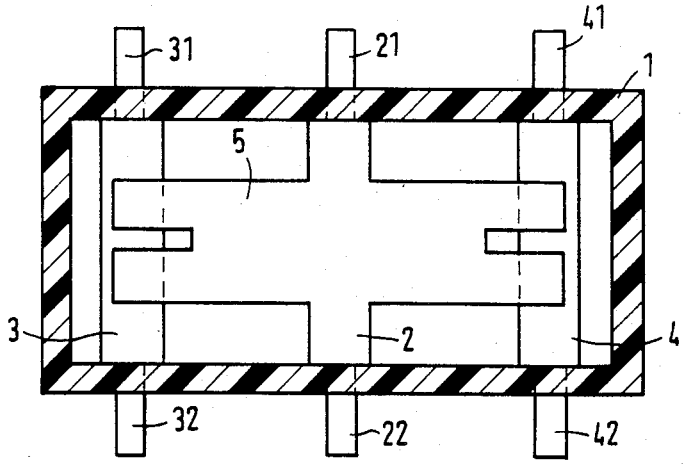
FIG. 6 is a vertical section taken through a slide switch according to another alternate embodiment of the present invention wherein the fixed and movable contacts are an integral, one-piece unit.

Both the central fixed contact and the contact bridge, however, may also be designed to form one piece, not requiring any subsequent connection of the two parts. One such type of embodiment is shown in FIG. 6 in which the central fixed contact 2 together with its terminals 21 and 22 as shaped thereto, as well as the contact bridge 5 are shown to consist of one single part.

Figure 7:
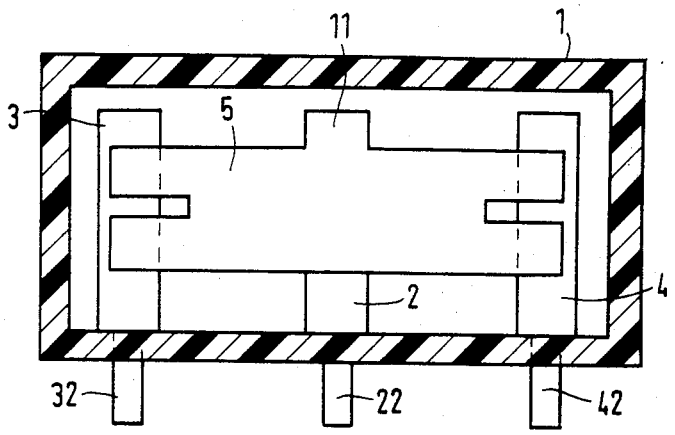
FIG. 7 is a vertical section taken through a slide switch according to another alternate embodiment of the present invention wherein the movable and fixed contacts are provided as an integral, one-piece unit which is mounted on one wall of the switch housing.

In the embodiment of the invetion as shown in FIG. 7, the central fixed contact with its terminal 22 as shaped thereto, and the contact bridge 5 also consist of one single part. In this type of embodiment the terminals for the contacts 2, 3 and 4 are only led out of the housing 1 on one side, as indicated by the reference numerals 22, 32 and 42. The central fixed contact 2 is bent over at the point indicated by the reference numeral 11 and continues in the contact bridge 5. In this type of embodiment the contact bridge 5, in its center part, has a greater movability than with the type of embodiment as shown in FIG. 6.

Figure 8:
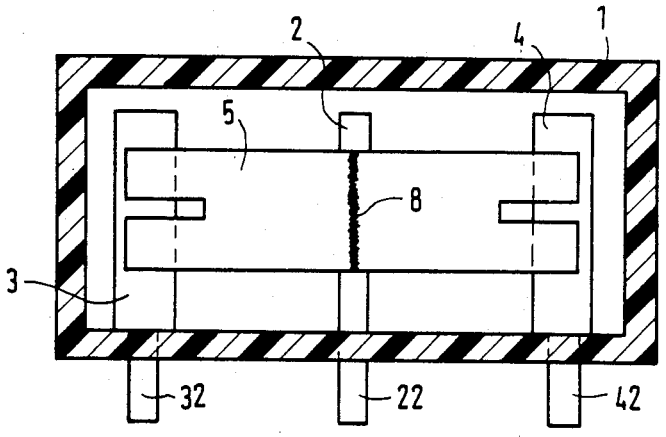
FIG. 8 is a vertical section taken through a slide switch according to still another embodiment of the present invention wherein the fixed contact is provided as a torsion bar welded to the movable contact.

FIG. 8, finally, shows an embodiment in which the central fixed contact 2 consists of a torsion rod. The fixed contact 2 consists of a rod of flexible material of either rectangular or square cross section. The contact bridge 5 is welded to the torsion rod 2 throughout its entire width as is indicated by the reference numeral 8. During the tilting of the contact bridge 5, the central fixed contact is turned resiliently around its longitudinal axis.

In all types of embodiment according to the invention, the contact bridge is mechanically and electrically firmly connected to the central fixed contact, so that the aforementioned difficulties, resulting from the rocker bearing, are avoided.

What is claimed is:

1. A slide switch comprising, in combination:

a switch housing;

a central fixed contact mounted in said housing;

a resilient contact bridge fixedly mounted to said fixed contact and being mechanically and integrally united therewith by at least a web of homogeneous material, and said contact bridge having deflectable arms extending in opposite direction away from said fixed contact;

a plurality of lateral fixed contacts mounted in said housing away from said central fixed contact for respectively engaging one of said arms of said contact bridge; and, a reciprocating slider movably mounted in said housing and having at least one cam surface for moving and deflecting said bridge contact into engagement with a selected one of said lateral contacts in response to movement of said slider wherein said central fixed contact is a torsion bar mounted at at least one of its end to said housing and extending in a direction perpendicular to said arms, whereby said torsion bar twists on its axis in response to deflection of said arms.

2. The switch according to claim 1, wherein said contact bridge is welded to said central fixed contact.

3. The switch according to claim 1, wherein said contact bridge and said central fixed contact are integrally formed as a single part from a strip of metal.

4. The switch according to claim 1, wherein said contact bridge is welded to said torsion bar.

* * * * *